US009048539B2

(12) United States Patent
Yen

(10) Patent No.: US 9,048,539 B2
(45) Date of Patent: Jun. 2, 2015

(54) MITIGATION OF UNDESIRED ELECTROMAGNETIC RADIATION USING PASSIVE ELEMENTS

(75) Inventor: Chih-Chuan Yen, Escondido, CA (US)

(73) Assignee: NETGEAR, Inc., San Jose, CA (US)

( * ) Notice: Subject to any disclaimer, the term of this patent is extended or adjusted under 35 U.S.C. 154(b) by 1346 days.

(21) Appl. No.: 12/822,241

(22) Filed: Jun. 24, 2010

(65) Prior Publication Data

US 2011/0316750 A1 Dec. 29, 2011

(51) Int. Cl.
*H01Q 19/28* (2006.01)
*H01Q 1/24* (2006.01)

(52) U.S. Cl.
CPC ..... *H01Q 1/245* (2013.01); *H01Q 19/28* (2013.01)

(58) Field of Classification Search
CPC ..... H01Q 1/245
USPC ..... 343/702, 841, 756, 833, 834
See application file for complete search history.

(56) References Cited

U.S. PATENT DOCUMENTS

| | | | | |
|---|---|---|---|---|
| 3,795,914 | A * | 3/1974 | Pickles | 343/756 |
| 4,387,377 | A | 6/1983 | Kandler | |
| 5,335,366 | A | 8/1994 | Daniels | |
| 5,367,309 | A | 11/1994 | Tashjian | |
| 5,550,552 | A | 8/1996 | Oxley | |
| 5,613,221 | A | 3/1997 | Hunt | |
| 5,657,386 | A | 8/1997 | Schwanke | |
| 5,666,125 | A | 9/1997 | Luxon et al. | |
| 5,826,201 | A | 10/1998 | Gratias | |
| 6,095,820 | A | 8/2000 | Luxon et al. | |
| 6,097,340 | A | 8/2000 | Chang | |
| 6,341,217 | B1 | 1/2002 | Wong | |
| 6,437,755 | B1 * | 8/2002 | Joshi | 343/841 |
| 6,628,784 | B1 | 9/2003 | Condemines | |
| 7,034,772 | B2 | 4/2006 | Woodward | |
| 7,274,953 | B2 | 9/2007 | Takagi et al. | |
| 8,150,484 | B2 * | 4/2012 | Laurent et al. | 455/575.7 |
| 2002/0137473 | A1 | 9/2002 | Jenkins | |
| 2004/0198264 | A1 | 10/2004 | Saur et al. | |
| 2008/0014872 | A1 | 1/2008 | Tucek et al. | |
| 2010/0234081 | A1 * | 9/2010 | Wong et al. | 455/575.5 |

OTHER PUBLICATIONS

Islam, Rubaiyat and ADVE, Raviraj, Beam-Forming by Mutual Coupling Effects of Parasitic Elements in Antenna Arrays, IEEE Antennas and Propagation Society Int'l Symposium, . . . .

(Continued)

*Primary Examiner* — Robert Karacsony
(74) *Attorney, Agent, or Firm* — Boyle Fredrickson, S.C.

(57) ABSTRACT

The present invention relates to an apparatus for mitigating undesired portions of electromagnetic radiation (EMR) associated with an antenna. The apparatus comprises a coupling element EM inductively coupled with the antenna, the coupling element being substantially co-polarized with the antenna. The apparatus further comprises one or more dissipating elements EM inductively coupled with the coupling element, each of the one or more dissipating elements being substantially differently polarized than the antenna, for example cross-polarized to the antenna. The coupling element may be a conductive element configured for predetermined EM inductive coupling with at least the antenna and the one or more dissipating elements. Each of the one or more dissipating elements may be a conductive element configured for predetermined EM inductive coupling with the coupling element. A method of manufacture is also provided.

19 Claims, 3 Drawing Sheets

(56) References Cited

OTHER PUBLICATIONS

SAR Shield, "SAR Shield Product Info" Internet Website Page, http://www.sarshield.com/english/product.htm.
Interact Communications, Inc., "Waveshield" Internet Website Page, http://www.waveshield.com.
Telebrands Corp., "Internal Cell Phone Antenna with Wave Scrambler" Product Information, AsSeenOnTV Internet Website Page, http://www.asseenontv.com/prod-pages, 2010.
Gale Cengage Learning, SV1, Inc.: SafeTShield Filters EM Waves Transmitted by Cellular and Cordless Phones, PR Newswire Association, LLC, Apr. 4, 2000.

* cited by examiner

MITIGATION OF UNDESIRED ELECTROMAGNETIC RADIATION USING PASSIVE ELEMENTS

FIELD OF THE INVENTION

The present invention pertains in general to systems of passive elements that absorb and reradiate electromagnetic radiation, and in particular to a method and apparatus for mitigating undesired portions of electromagnetic radiation (EMR) associated with an antenna.

BACKGROUND

In many wireless communication devices such as cellular telephones, wireless-enabled laptops, wireless-enabled personal digital assistant (PDA) devices, and the like, radio transmitters are often situated in close proximity to a human user. There is currently concern that exposure to electromagnetic radiation emitted by such transmitters may pose a health risk to the user or other persons sufficiently close to the transmitter. Undesired electromagnetic radiation may also interfere with operation of nearby electronics or communication devices.

To reduce health risks, regulatory bodies such as the FCC have mandated limits for safe exposure to radio frequency (RF) energy corresponding to electromagnetic radiation of such transmitters. These limits are given in terms of a unit referred to as the Specific Absorption Rate (SAR), which is a measure of the amount of radio frequency energy absorbed by the body when using a wireless communication device. The FCC requires device manufacturers to ensure that their devices comply with these objective limits for safe exposure. The current FCC limit to public exposure from cellular telephones is an SAR level of 1.6 watts of absorbed RF energy per kilogram of body tissue. Some users may seek to reduce their exposure to RF energy even below the FCC limit.

Several approaches have been proposed to reduce undesired exposure to RF energy by deflection. For example, U.S. Pat. No. 7,034,772 discloses a flexible metallic tape, shaped around the antenna, for deflecting and blocking antenna radiation from cellular telephones. As another example, United States Patent Application Publication No. 2004/0198264 discloses a telephone radiation shielding apparatus including a conductive sheet and strip to receive incident ionizing and non-ionizing radiation. The shield may be built in to a telephone or provided in a modification kit. As another example, United States Patent Application Publication No. 2002/0137473 discloses a shield apparatus for placement over speaker openings of a cellular phone to obstruct electromagnetic radiation. The shield comprises two layers of metallic mesh and reportedly absorbs the radiation, while the mesh structure allows the passage of sound waves. As another example, U.S. Pat. No. 6,341,217 discloses a portable telephone having an antenna and a grounded metallic surface interposed between antenna and user. The metallic surface is spaced apart from the antenna by one-quarter wavelength to maximize reflection. As another example, U.S. Pat. No. 6,095,820 discloses an antenna assembly including a driven antenna and a shield apparatus which absorbs and redirects radiation outward away from the user.

However, the above approaches may cause undesirable negative effects on device transmitter operation. For example, mutual coupling between the metallic shield and the device antenna may negatively impact antenna operation. These approaches represent broad or untargeted attempts to minimize exposure to electromagnetic radiation which may not be feasible in some cases.

As another approach, United States Patent Application No. 2008/0014872 discloses a tuned passive antenna which captures cellular telephone antenna radiation and converts the captured radiation to electric current, which is dissipated by operating a thermal, mechanical or electrical device, thereby reducing exposure to undesired electromagnetic radiation. However, this approach requires conversion of captured RF energy to a form usable by the device being operated, which may be complicated and inefficient.

Therefore there is a need for a device for reducing exposure to electromagnetic radiation that is not subject to one or more limitations in the prior art.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a method and apparatus for mitigation of undesired portions of electromagnetic radiation associated with an antenna. In accordance with an aspect of the present invention, there is provided an apparatus for mitigating undesired portions of electromagnetic radiation (EMR) associated with an antenna, the apparatus comprising: a coupling element EM inductively coupled with the antenna, the coupling element being co-polarized with the antenna; and one or more dissipating elements EM inductively coupled with the coupling element, each of the one or more dissipating elements being differently polarized than the antenna.

In accordance with another aspect of the present invention, there is provided a communication device comprising an antenna and an apparatus for mitigating undesired portions of electromagnetic radiation (EMR) associated with the antenna, the apparatus comprising: a coupling element EM inductively coupled with the antenna, the coupling element being co-polarized with the antenna; and one or more dissipating elements EM inductively coupled with the coupling element, each of the one or more dissipating elements being differently polarized than the antenna.

BRIEF DESCRIPTION OF THE FIGURES

These and other features of the invention will become more apparent in the following detailed description in which reference is made to the appended drawings.

DETAILED DESCRIPTION OF THE INVENTION

Definitions

Figure 1:
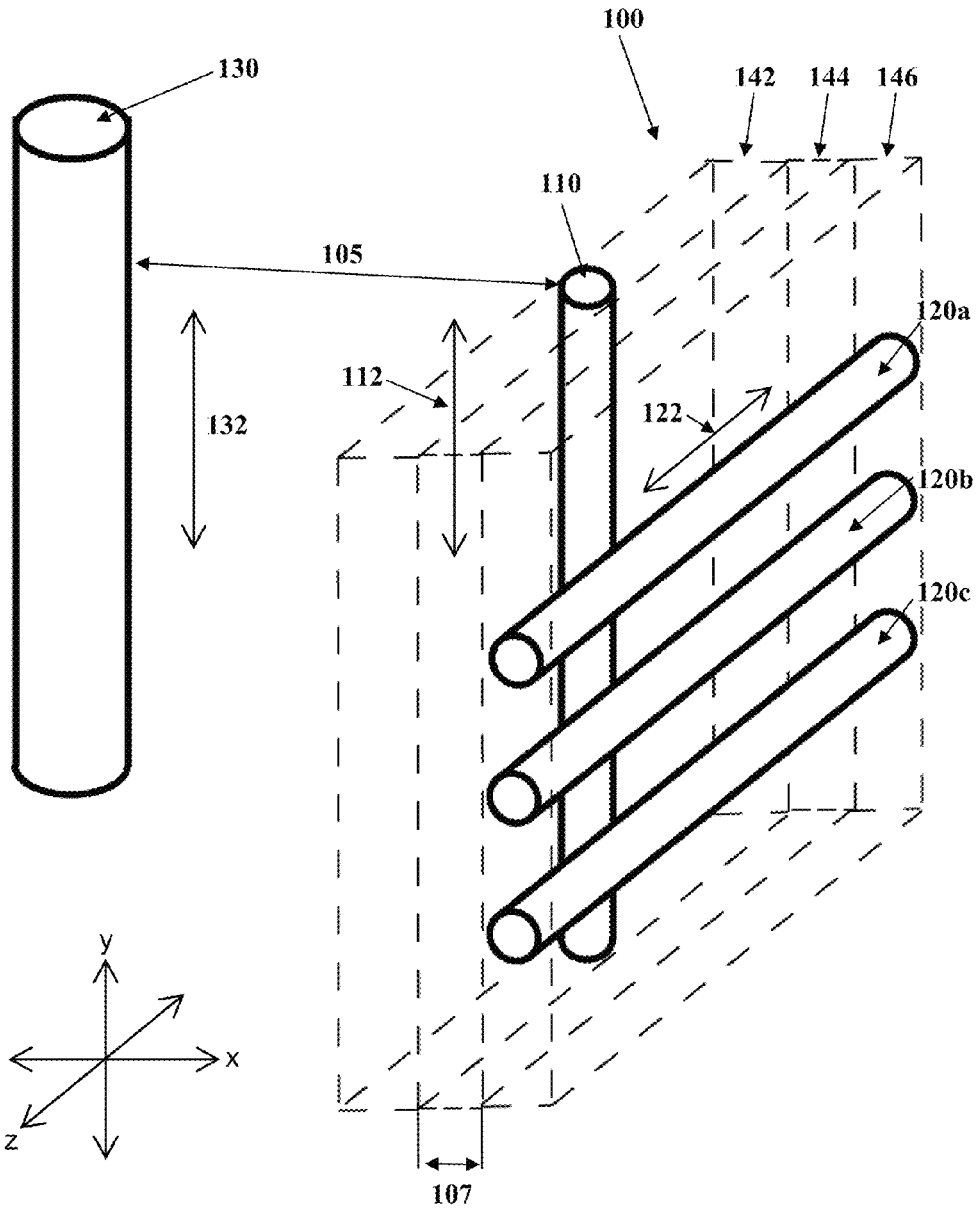
FIG. 1 illustrates an apparatus operatively coupled to a transmit radio antenna in accordance with embodiments of the present invention.

As used herein, the term "conductive element" refers to a body of material which substantially interacts with an electric field, a magnetic field, or an electromagnetic field.

As used herein, the term "electromagnetic coupling" refers to an interaction between two or more conductive elements via an electric field, magnetic field, or electromagnetic field.

As used herein, the term "conductive coupling" refers to an electromagnetic coupling between two conductive elements formed by direct electrical contact. Conductive coupling may be provided via intermediary such as a solder joint, metallic bonding, wire, material contact, resistor, or via, for example.

As used herein, the term "capacitive coupling" refers to an electromagnetic coupling between two conductive elements which are proximate to each other but separated by a gap in a region of interest, wherein a varying electrical field exists between the two conductive elements, inducing a change in voltage across the gap. For example, the size of the gap is typically on the order of a fraction of a wavelength. In some embodiments the size of the gap is on the order of a tenth of a wavelength.

As used herein, the term "magnetic coupling" refers to an electromagnetic coupling between two conductive elements which are proximate to each other but separated by a gap in a region of interest, wherein a varying magnetic field exists between the two conductive elements, inducing a change in voltage in at least one of the conductive elements. For example, the size of the gap is typically on the order of a fraction of wavelength of an electrical signal of interest. In some embodiments the size of the gap is on the order of a tenth of a wavelength.

As used herein, the terms "electromagnetic inductive coupling" and "near-field coupling" interchangeably refer to a capacitive coupling, magnetic coupling, or a combination thereof. For example, EM inductive coupling can be the coupling of interest in the near field of an antenna or antenna-like element. EM inductive coupling between conductive elements typically increases in strength the closer the elements are to each other.

As used herein, the terms "radiative coupling" and far-field coupling interchangeably refer to an electromagnetic coupling between two conductive elements which are separated by a distance on the order of several wavelengths or more of an electrical signal of interest. For example, radiative coupling can be the coupling of interest in the far field of an antenna or antenna-like element.

As used herein, the term "polarization" relates to the orientation of an electric field in a predetermined region of space and/or the orientation of an electric field associated with a conductive element resonant therewith, such as an antenna or passive element, in a predetermined region of space.

As used herein, the term "co-polarization" relates to relative polarizations of two or more electric fields and/or conductive elements, such that the polarizations are substantially the same.

As used herein, the term "different polarization" relates to relative polarizations of two or more electric fields and/or conductive elements, such that the polarizations are substantially different.

As used herein, the term "cross polarization" relates to relative polarizations of two or more electric fields and/or conductive elements, such that the polarizations are substantially orthogonal.

As used herein, the term "about" refers to a +/−10% variation from the nominal value. It is to be understood that such a variation is always included in a given value provided herein, whether or not it is specifically referred to.

Unless defined otherwise, all technical and scientific terms used herein have the same meaning as commonly understood by one of ordinary skill in the art to which this invention belongs.

The present invention relates to an apparatus for mitigating undesired portions of electromagnetic radiation (EMR) associated with an antenna. The apparatus comprises a coupling element EM inductively coupled with the antenna, the coupling element being substantially co-polarized with the antenna. The apparatus further comprises one or more dissipating elements EM inductively coupled with the coupling element, each of the one or more dissipating elements being substantially differently polarized than the antenna, for example cross-polarized to the antenna. The coupling element may be a conductive element configured for predetermined EM inductive coupling with at least the antenna and the one or more dissipating elements. Each of the one or more dissipating elements may be a conductive element configured for predetermined EM inductive coupling with the coupling element.

Embodiments of the present invention relate to a method of manufacturing an apparatus for mitigating undesired portions of electromagnetic radiation (EMR) associated with an antenna.

Embodiments of the present invention relate to a method of manufacturing a communication device, the communication device comprising an antenna and an apparatus for mitigating undesired portions of electromagnetic radiation (EMR) associated with the antenna.

In some embodiments, an apparatus in accordance with the present invention may be configured so as to facilitate reduced disruption of antenna operation, wherein the disruption may be due to mutual coupling effects between portions of the apparatus and the antenna. For example, such disruption may relate to detuning of the antenna, changing impedance of the antenna, or a combination thereof, or the like. In some embodiments, a difference in polarization between the one or more dissipating elements and the antenna may facilitate reduced disruption of antenna operation. For example, the dissipating elements may be configured to emit electromagnetic radiation having a principal or major axis of polarization substantially different from a principal or major axis of polarization of the antenna. Moreover, the coupling and dissipating elements may each be configured having a substantially linear or nearly linear polarization for a frequency range of interest. In some embodiments, the principal polarization of the dissipating elements are about orthogonal to that of the antenna. For example, polarization of EMR emitted by the dissipating elements may be, at a point in space occupied by the antenna, in a direction such that, at frequencies of the EMR, the EMR does not substantially couple onto the antenna.

In embodiments of the present invention, strength of EM inductive coupling between conductive elements is dependent on various factors, such as frequency of electromagnetic waves of interest, for example radio frequency, proximity of the conductive elements, and configuration of the conductive elements, for example relative position and polarization thereof. For example, a conductive element may be shaped such that, when placed in the path of a transverse electromagnetic wave having a predetermined frequency and predetermined substantially linear or nearly linear polarization, the conductive element will tend to electromagnetically couple with the electromagnetic wave to different degrees as the conductive element is rotated in a plane transverse to propagation of the electromagnetic wave. In some embodiments, when said electromagnetic coupling is substantially at a maximum, the conductive element and electromagnetic wave are co-polarized; when the electromagnetic coupling is substantially at a minimum, the conductive element and electromagnetic wave are substantially differently polarized and potentially cross-polarized. For many configurations of a conductive element, the difference in coupling between co-polarized and differently polarized positions may be substantial, for example they may differ by several decades.

For example, for two substantially linearly polarized, electromagnetically coupled conductive elements, relative power transfer loss due to polarization mismatch may be characterized by a power loss factor. In an idealized scenario, when the angle between the polarizations of the two conductive elements is $\phi$, the power transfer factor can be represented as $\cos^2 \phi$. Thus, if the two conductive elements have the same polarization (are co-polarized), $\phi=0$ and the power transfer factor is equal to one, indicating no substantial power loss, and maximum coupling between the two conductive elements; if the two conductive elements are cross-polarized, $\phi=90°$ and the power transfer factor is equal to zero, indicating substantially complete power loss, and minimum coupling between the two conductive elements.

In some embodiments, the coupling element is configured to be closer to the one or more dissipating elements than it is to the antenna. This may facilitate a desired transfer of electromagnetic energy from the antenna to the one or more dissipating elements, since the coupling element may be adequately EM inductively coupled with the antenna due at least in part to co-polarization, and the coupling element may further be adequately EM inductively coupled with the one or more dissipating elements due at least in part to proximity. In some embodiments, the separation between coupling element and dissipating elements may be at least a decade smaller, half the size, or the like, compared to a separation between coupling element and antenna. In some embodiments, the coupling element is positioned relative to the antenna in manner such that detuning is substantially avoided. In some embodiments, the one or more dissipating elements are positioned substantially as close as possible to the coupling element in order to substantially maximize coupling efficiency therebetween.

In some embodiments, providing plural dissipating elements may further facilitate a desired transfer of electromagnetic energy from the antenna to the one or more dissipating elements via the one or more coupling elements.

In some embodiments, one or more aspects of coupling element, dissipating element, or both, such as size, shape, material, orientation, number, and positioning, relative to one or more antennas, are configured to facilitate a desired operation of the present invention. For example, said one or more aspects may be configured such that an instantaneous or average amount of RF energy transferred from the one or more antennas to the one or more coupling elements is a substantial proportion of a substantially concurrent instantaneous or average amount of RF energy transferred from the one or more coupling elements to the one or more dissipating elements. In this manner, a substantial proportion of RF energy absorbed by the apparatus may be dissipated by the one or more dissipating elements. In some embodiments, said substantial proportion may be in excess of 10%. In some embodiments, the substantial proportion may be in excess of 50%. In some embodiments, the substantial proportion may approach 100%.

FIG. 1 illustrates a coupler-dissipater apparatus 100 operatively coupled to a transmit radio antenna 130 in accordance with an embodiment of the present invention. The antenna emits electromagnetic radiation in one or more directions, including toward the apparatus 100.

The apparatus 100 illustrated in FIG. 1 comprises a coupling element 110, which is a conductive element EM inductively coupled to the antenna 130. The coupling element 110 is oriented to be substantially co-polarized with the antenna 130. In FIG. 1, the antenna 130 is substantially linearly polarized in the y-axis direction, as indicated by arrow 132. The coupling element 110 is also substantially linearly polarized in the y-axis direction, as indicated by arrow 112. For example, as illustrated, the coupling element 110 may be formed as an elongated conductive cylinder having its longest side substantially parallel to the y-axis. In some embodiments the coupling element may also be formed as a rectangular strip instead of a cylinder. Co-polarization of the antenna 130 and the coupling element 110 may result in substantial EM inductive coupling therebetween, for example with respect to RF energy within a predetermined frequency band. The coupling element 110 is separated from the antenna 130 by a distance 105. This is also about the separation distance between the apparatus 100 and the antenna 130.

As further illustrated in FIG. 1, the apparatus 100 comprises three dissipating elements 120*a*, 120*b*, 120*c*, although more or fewer dissipating elements may be used. Each dissipating element 120*a*, 120*b*, 120*c* is oriented to be substantially orthogonally polarized to the antenna 130. For example, as illustrated, the dissipating elements 120*a*, 120*b*, 120*c* may be substantially linearly polarized in the z-axis direction, as indicated by arrow 122. The dissipating elements 120*a*, 120*b*, 120*c* may each be formed as elongated conductive cylinders having their longest side substantially parallel to the z-axis. In some embodiments, the dissipating elements may be formed as rectangular strips or other shapes instead of cylinders. Orthogonal polarization or cross-polarization of the antenna 130 and the dissipating elements 120*a*, 120*b*, 120*c* may result in a substantially low EM inductive coupling therebetween, for example with respect to RF energy within a predetermined frequency band. The coupling element 110 is separated from the dissipating elements 120*a*, 120*b*, 120*c* by a distance 107.

In some embodiments, the apparatus 100 comprises a first layer 142 bonded or integrally formed with a second layer 144, and a third layer 146 bonded or integrally formed with the second layer 144, the second layer 144 interposed between the first layer 142 and the third layer 146. The first layer contains therein the coupling element 110, the second layer, having width 107, is a layer of insulating or dielectric material, and the third layer contains therein the dissipating elements 120*a*, 120*b*, 120*c*. The first layer 142, second layer 144 and third layer 146 may be formed within a rigid or flexible monolithic or layered material, for example.

In some embodiments, the distance 107 between coupling element 110 and dissipating elements 120*a*, 120*b*, 120*c*, is substantially smaller than the distance 105 between antenna 130 and coupling element 110. This may result in EM inductive coupling being stronger between coupling element 110 and dissipating elements 120*a*, 120*b*, 120*c* than it would be were the coupling and dissipating elements separated by distance 107. However, this effect is at least partially offset by polarization effects. That is, EM inductive coupling between coupling element 110 and dissipating elements 120*a*, 120*b*, 120*c* is weaker than it would be were the coupling and dissipating elements co-polarized.

In some embodiments, the one or more dissipaters are positioned between the antenna and the coupling element.

In various embodiments, an apparatus according to the present invention may be substantially smaller, about the same size, or substantially larger than the antenna. In some embodiments, an apparatus according to the present invention may be operatively coupled to plural antennas.

Antenna

An antenna according to or operating with embodiments of the present invention may be configured in a number of different ways, for example, as a monopole, dipole or other antenna, an inverted F antenna, a planar inverted F antenna (PIFA), a fractal antenna, patch, slot, aperture, spiral or loop antenna, or other antenna used in wireless devices, folded dipole or multipole, directional or self-similar antenna, or other antenna, or arrays of antennas. An antenna according to or operating with embodiments of the present invention may be sized and shaped appropriately to provide one or more desired features, such as portability, power consumption, bandwidth, transmission or reception in a predetermined frequency range, or the like. Antennas may be substantially linearly polarized in a predetermined direction, or elliptically polarized according to an ellipse having its major axis substantially larger than its minor axis.

An antenna according to or operating with embodiments of the present invention may be configured having a radiation pattern corresponding to one or more predetermined near-field radiation characteristics. For example, the near-field radiation characteristics may include electrical and/or magnetic field strength, and/or polarization at predetermined locations relative to the antenna and/or in predetermined directions at corresponding locations. The radiation pattern may also be a function of frequency.

According to some embodiments of the present invention, the antenna radiation pattern may provide one or more regions of relatively increased electrical and/or magnetic field strengths, and corresponding increased electromagnetic radiation (EMR), at one or more predetermined locations proximate the antenna when drive current is provided to the antenna. According to an embodiment of the present invention, the one or more local maxima and/or predetermined locations may depend on the magnitude of the corresponding antenna drive current. Regions of increased radiation may be referred to as hotspots. An antenna may have one or more hotspots, each associated with a region of locally increased radiation. Antenna hotspots may be problematic as they may potentially result in increased exposure of a user to electromagnetic radiation, for example.

Coupling Element

The apparatus comprises one or more coupling elements configured for EM inductive coupling to an antenna or antenna array. Each coupling element may behave as a passive or parasitic electromagnetic element in the presence of an operating antenna, absorbing and re-radiating electromagnetic energy and effectively modifying the electromagnetic field pattern around the antenna.

Each coupling element is a conductive element which may be configured as to its size, shape, orientation, polarization, material, and the like. For example, each coupling element may be formed as a prism with a rectangular or other polygonal cross section, a cylinder, or the like. In one embodiment, a coupling element may be formed as a substantially long and flat strip, for example as formed by a conductive circuit board trace or lithographically provided conductive body.

Each coupling element may be configured and oriented to substantially absorb RF energy within a predetermined frequency range. For example, the length of a coupling element may be configured as a resonant length relative to one or more predetermined radio frequencies.

Each coupling element may be configured and oriented to substantially absorb RF energy having a predetermined polarization. In some embodiments, the coupling element may be oriented such that it is substantially co-polarized with the antenna. For example, the coupling element may be positioned at a predetermined location proximate to a substantially linearly polarized antenna, which may result in the electric and magnetic fields being polarized primarily in predetermined directions at that location. Co-polarization of the coupling element at that location may comprise orienting the coupling element such that induced current flowing within the coupling element, due to RF energy radiated by the antenna within a predetermined frequency range, is about at a local or global maximum.

For example, for an elongated coupling element which is formed by a wire or circuit board trace, co-polarization may comprise orienting the elongated coupling element such that its longest dimension is substantially parallel to the electric field, or major axis thereof, associated with the antenna.

In some embodiments, each coupling element may have a substantially linear or nearly linear polarization with respect to EMR in a predetermined frequency range. Each coupling element may thereby be configured such that, for EMR in the predetermined frequency range having a polarization substantially the same as the coupling element polarization, the coupling element is strongly coupled to the EMR, whereas, for EMR in the predetermined frequency range having a polarization substantially different to the coupling element polarization, the coupling element is substantially weakly coupled to the EMR relative to the co-polarized case. The difference in coupling strengths between the two cases may be substantial, for example several decades. For example, an elongated coupling element may have a substantially low amount of coupling with EMR having its electric field orthogonal to the longest dimension of the elongated coupling element, compared with EMR having its electric field parallel to said longest dimension.

In some embodiments, plural coupling elements are placed proximate to each other in the same apparatus. Each of the plural coupling elements may be further operatively coupled to one or more dissipating elements. The number and relative placement and orientation of plural coupling elements may be configured to achieve one or more desired effect.

In some embodiments, plural coupling elements may be configured to mutually interact, analogous to mutual interaction or coupling of an antenna array. In some embodiments, plural coupling elements may be configured so as to reduce potential for mutual interaction therebetween.

Dissipating Elements

The apparatus comprises one or more dissipating elements configured for EM inductive coupling to the one or more coupling elements. Each dissipating element may behave as a passive or parasitic electromagnetic element in the presence of one or more coupling elements. Each dissipating element may absorb and re-radiate electromagnetic energy emitted by said one or more coupling elements, and effectively modify the electromagnetic field pattern around the antenna.

Each dissipating element is a conductive element which may be configured as to its size, shape, orientation, polarization, material, and the like. For example, each dissipating element may be formed as a prism with a rectangular or other polygonal cross section, a cylinder, or the like. In one embodiment, a dissipating element may be formed as a substantially long and flat strip, for example as formed by a conductive circuit board trace or lithographically provided conductive body.

In some embodiments, each dissipating element may be configured and oriented to substantially absorb RF energy within a predetermined frequency range. For example, the length of a dissipating element may be configured as a resonant length relative to one or more predetermined radio frequencies.

Each dissipating element may be configured and oriented to substantially radiate RF energy having a predetermined polarization. In some embodiments, a dissipating element may be oriented such that it is substantially differently polarized from one or more antennas, coupling elements, or both. For example, at a predetermined location proximate to a substantially linearly polarized dissipating element corresponding to the location of an antenna or coupling element, the electric and magnetic fields corresponding to EMR emitted by a dissipating element may be polarized primarily in predetermined directions. Cross-polarization of the antenna or coupling element and dissipating element at that location may comprise orienting the dissipating element such that induced current flowing within the antenna or coupling element, due to RF energy radiated by the dissipating element within a predetermined frequency range, is about at a local or global minimum.

In some embodiments, each dissipating element may have a substantially linear or nearly linear polarization with respect to EMR in a predetermined frequency range. Each dissipating element may thereby be configured such that, for EMR in the predetermined frequency range having a polarization substantially the same as the dissipating element polarization, the dissipating element is strongly coupled to the EMR, whereas, for EMR in the predetermined frequency range having a polarization substantially different to the dissipating element polarization, the dissipating element is substantially weakly coupled to the EMR, relative to the co-polarized case. The difference in coupling strengths between the two cases may be substantial, for example several decades. For example, an elongated dissipating element may have a substantially low amount of coupling with EMR having its electric field orthogonal to the longest dimension of the elongated dissipating element, compared with EMR having its electric field parallel to said longest dimension.

For example, for an elongated dissipating element such as a formed by a wire or circuit board trace, cross-polarization may comprise orienting the elongated dissipating element such that its longest dimension is substantially perpendicular to the electric field, or major axis thereof, associated with one or more antennas and/or coupling elements.

In some embodiments, plural dissipating elements are placed proximate to each other in the same apparatus. Each of the plural dissipating elements may be further operatively coupled to a common set of one or more coupling elements, separate sets of one or more coupling elements corresponding to each dissipating element, or a combination thereof. The number and relative placement and orientation of plural dissipating elements may be configured to achieve one or more desired effect.

In some embodiments, plural dissipating elements may be configured to mutually interact, analogous to mutual interaction or coupling of an antenna array. In some embodiments, plural dissipating elements may be configured so as to reduce potential for mutual interaction therebetween.

Mutual Interaction

Plural conductive elements, when arranged in certain formations, may collectively exhibit electromagnetic behaviour due to interaction between elements. For example, antenna arrays and arrays of passive and active antenna elements, such as in a Yagi-Uda antenna array, may be configured to exhibit an overall electromagnetic radiation pattern resulting from both the individual configuration of each element and the relative spacing and orientation between elements.

In embodiments of the present invention, plural coupling elements, dissipating elements, or combinations thereof, may be arranged relative to each other so as to exhibit predetermined collective radiation patterns due to mutual interaction. Furthermore, in embodiments of the present invention, plural coupling elements, dissipating elements, or combinations thereof may be arranged relative to each other so as to inhibit predetermined collective radiation patterns due to mutual interaction. Furthermore, in embodiments of the present invention, plural instances of an apparatus may be arranged relative to each other so as to exhibit or inhibit predetermined collective radiation patterns due to mutual interaction.

Apparatus Placement

In some embodiments, determining placement of the apparatus may comprise initial testing, simulation and/or modelling of the antenna in isolation to determine the radiation pattern thereof, and optionally to determine locations of one or more hotspots thereof. Determining placement of the apparatus may further comprise testing, simulation and/or modelling of the antenna in the presence of a version of the apparatus, placed proximate to the antenna at a predetermined location, for example at a location corresponding to a hotspot. A desired placement and configuration of the apparatus may be determined for example by testing various placements and configurations, and determining a desired placement and configuration through analysis, trial and error, or the like.

In some embodiments, apparatus placement and configuration is evaluated based at least in part on mitigation of the electromagnetic field strength in one or more directions. In some embodiments, apparatus placement and configuration is evaluated based at least in part on mutual coupling effects between the apparatus and the antenna, for example by evaluating a change in antenna impedance, total radiated power and/or antenna efficiency due to mutual coupling of the antenna with the apparatus. In some embodiments, apparatus placement and configuration is determined such that changes to antenna impedance, total radiated power and/or antenna efficiency are minimized or kept below a predetermined threshold. In some embodiments, apparatus placement and configuration is determined based on multiple evaluation criteria, for example a trade-off between a desired mitigation of electromagnetic field strength in a predetermined spatial region and a desired level of interference with antenna impedance, power or efficiency.

In some embodiments, the apparatus may be placed such that it absorbs electromagnetic radiation within a hotspot of the antenna, and dissipates the radiation so as to mitigate the hotspot. In some embodiments, hotspot mitigation comprises reducing electromagnetic radiation or field strength in a region of space irradiated by the antenna, said region of space potentially being occupied by human tissue, for example of a user of a device associated with the antenna. The apparatus may be placed within or near the hotspot, at a location which is determined to be effective for hotspot mitigation. Electromagnetic radiation or field strength may be reduced by diffusing RF energy over a wider area, for example, thereby reducing peak EMR in a localized region of space.

In some embodiments, the apparatus is situated between the antenna and the expected location of a proximate human, such as the user of a cellular telephone radio-enabled laptop, or wireless adapter containing the antenna. That is, the apparatus may be placed proximate to the antenna at a location which does not necessarily correspond to a hotspot. The apparatus location may be such that the apparatus mitigates radiation within to a predetermined region of concern, such as a region anticipated to be occupied by human tissue, for example of a user of a device associated with the antenna. For example, for a cellular telephone, the apparatus may be placed at a predetermined location between the antenna and the anticipated location of a user's head or portion thereof.

In some embodiments, the apparatus may be configured to mitigate EMR so as to reduce interference between the antenna and electronic components or other communication devices. Such use of the apparatus may be in addition to or alternative to use in mitigating irradiation of human tissue. For example, the apparatus may be configured to reduce electromagnetic field strength in a region containing digital electronic components associated with the antenna, such as microprocessors, digital signal processors, digital memory, communication buses, control electronics, user interface electronics, or the like.

In some embodiments, plural instances of the apparatus may be placed proximate to an antenna. For example, plural instances of the apparatus may each be placed within or near a different hotspot. Placement and configuration of plural instances of the apparatus may be determined taking into account the mutual interaction between all instances of the apparatus and the antenna or antennas.

Communication Device

Embodiments of the present invention may be directed toward mitigating undesired portions of electromagnetic radiation (EMR) associated with one or more antennas of a communication device, such as a cellular telephone, wireless network adapter, laptop, personal digital assistant, smartphone, machine-type communication (MTC) equipment, or the like.

In some embodiments, an apparatus in accordance with the present invention comprises or is integrally formed with a communication device. For example, the apparatus may be built into a housing of a communication device at a predetermined location and orientation, attached to the communication device in a predetermined manner, or the like. The apparatus may be built into the interior or exterior of a housing or chassis of a communication device, for example using printing, overmolding, or the like.

In some embodiments, the apparatus comprises an adhesive portion for adhering to a communication device at a predetermined location, such as the external or internal side of a housing thereof. According to some embodiments, the apparatus is configured specifically for operation with the associated communication device, and adhered at a specified location to achieve a desired operation. In some embodiments, arbitrary configuration and placement of the apparatus with respect to an antenna of a communication device may be possible, but may not achieve optimal results.

In some embodiments, the apparatus is configured to achieve a desired effect, such as mitigation of hotspots or undesired portions of EMR associated with an antenna, while also resulting in adverse effects on other predetermined operational parameters of an associated antenna or communication device being held to a degree below a predetermined threshold.

For example, in some embodiments, the apparatus may be associated with a previously designed antenna system, the apparatus configured such that mutual coupling effects between apparatus and antenna result in a desirably low amount of alteration to one or more antenna operational characteristics. For example, the apparatus may be configured such that deviations to impedance matching or total radiated power associated with the antenna are maintained below a predetermined threshold.

In some embodiments, the apparatus and antenna system may be designed together, such that desirable operational characteristics such as antenna system impedance matching, antenna total radiated power, antenna resonant frequency and/or bandwidth, and the like, are obtained.

For example, parasitic elements placed in the near field of an antenna may detune the antenna, change the antenna impedance, or a combination thereof, or the like, as would be readily understood by a worker skilled in the art. For example, antenna impedance may be representative of magnitude and phase relationships between current and voltage signals, in a predetermined frequency range, applied at the input terminal of a transmitting antenna. When the antenna impedance is changed without a corresponding change to the impedance associated with systems operatively coupled thereto, such as transmission lines, transmission line stubs, RF front end components, amplifiers, or the like, a loss in power transfer efficiency to or from the antenna may occur. That is, introduction of parasitic elements EM inductively coupled to the antenna may result in an impedance mismatch condition between the antenna and associated systems coupled thereto. This may result in undesired degradation to antenna operational characteristics, such as total radiated power of the antenna, since energy may be reflected due to the impedance mismatch. Therefore, embodiments of the present invention may facilitate introduction of parasitic elements, such as coupling and dissipating elements, into the antenna near field without substantial degradation in operational characteristics. This may be accomplished for example by reducing mutual interaction between antenna and apparatus by providing a difference in polarization between antenna and dissipating elements, by concurrent design of the antenna system and coupler-dissipater apparatus, or a combination thereof.

In some embodiments, the apparatus is configured to reradiate at least a portion of incident RF energy absorbed thereby at a different polarization than a main polarization of an antenna EM inductively coupled to the apparatus. Not all RF energy need be reradiated at a different polarization. For example, if even 10% of the RF energy absorbed by the apparatus were reradiated such that the reradiated RF energy had, at a point in space occupied by the antenna, a polarization substantially different than a main polarization of the antenna, then that proportion of reradiated RF energy would cause substantially little current oscillation in the antenna. Therefore, in some embodiments, mutual coupling effects between such an antenna and apparatus would be reduced. Embodiments of the invention may facilitate reduction in mutual coupling between antenna and apparatus, possibly along with other approaches, by a predetermined desired amount, thereby reducing undesired effects such as antenna detuning or impedance mismatch due to the apparatus. The extent to which plural goals are achieved, such as reduction in antenna detuning or impedance mismatch, and hotspot mitigation or EMR mitigation in a predetermined region, or the like, may be interrelated and determined due to one or more design trade-offs. For example, the apparatus may be designed to mitigate a hotspot as much as possible while not causing an impedance mismatch at the antenna of more than 5%.

Embodiments of the present invention are configured to diffuse or spread electromagnetic radiation emitted by an antenna, thereby reducing or redirecting one or more energy peaks associated with antenna radiation patterns. For example, by placing an appropriately configured apparatus, in accordance with the present invention, in an antenna hotspot, EMR in a predetermined spatial region may be reduced, by spreading incident EMR over a larger spatial region.

In some embodiments, the present invention may be configured to diffuse or spread EMR so as to facilitate compliance with regulatory requirements, such as SAR requirements, or other internally or externally defined requirements. For example, by reducing peak EMR intensity in a predetermined region by diffusing or spreading, SAR measurements in that same region may also be reduced. This may increase safety or perception of safety to a user of a communication device incorporating the present invention.

Method of Manufacture

In some embodiments, a communication device incorporating aspects of the present invention, and/or a coupler-dissipater apparatus in accordance with the embodiments of the present invention may be provided in accordance with one or more methods as described herein.

In some embodiments, a method of manufacturing an apparatus in accordance with the present invention comprises providing one or more coupling elements and one or more dissipating elements attached to or embedded in a substrate. For example, the coupling elements and dissipating elements may be provided as layers on a printed circuit board, in accordance with patterning or etching techniques such as silk screening, photoengraving, electroplating or milling of conductive layers laminated onto an insulating material. As another example, coupling elements and dissipating elements may be encased in an insulating material such as plastic, resin, or the like. Other techniques, such as photolithography, hand assembly, or the like, may also be employed in embodiments of the present invention.

In some embodiments, a method of manufacturing a communication device in accordance with the present invention comprises attaching or embedding one or more coupling elements and dissipating elements, or a substrate containing same at predetermined locations of the communication device relative to one or more antennas thereof. Configuration of the coupling elements and location, such as orientation and distance from one or more antenna and possibly other electromagnetically relevant elements such as ground planes, may be determined by previous design. A housing or interior element of the communication apparatus may be configured to receive the one or more coupling elements and dissipating elements, or a substrate containing same at a predetermined location. For example, a coupler-dissipater apparatus may be adhered to an inner or outer wall of a communication apparatus housing, overmolded to the housing, printed on or within the housing, or the like. In some embodiments, manufacturing may comprise configuring the communication apparatus to receive, for example in a cavity, slot, or housing portion thereof, a coupler-dissipater apparatus printed on a circuit board or other substrate as part of coupling apparatus assembly.

In embodiments of the present invention, methods of manufacture comprise adequately accurate definition, placement and orientation of coupling elements, dissipating elements, and optionally antenna and/or other elements.

Method of Design

In some embodiments, finite difference time domain (FDTD) techniques, method of moments (MoM) techniques, or other techniques known to a worker skilled in the art, may be used for computation and simulation for design purposes of the apparatus in accordance with embodiments of the present invention. Such techniques may be regarded as numerical methods for approximately solving Maxwell's equations to determine electromagnetic characteristics related to embodiments of the present invention in predetermined interaction with one or more antennas.

In some embodiments, off-the-shelf or specially configured computer programs may be used to facilitate design. For example, computer programs may be used for modeling, analysis, or both, of antenna system electromagnetic and/or current distribution behaviour, apparatus electromagnetic and/or current distribution behaviour, or a combination thereof.

In some embodiments, the antenna system and coupler-dissipater apparatus may be co-configured. For example, impedance matching between the antenna and electronics associated therewith, such as an RF front-end, power amplifier, low-noise amplifier, transmission line, or the like, may be configured taking into account mutual coupling effects due to a coupler-dissipater apparatus provided. The antenna system and apparatus may be concurrently designed in embodiments of the present invention, design of each accounting for the other, to provide desirable operation.

For example, antenna system components, such as antennas and electronics coupled thereto, and coupler-dissipater apparatus components may be designed and analyzed simultaneously or sequentially. One or more such components may be modified at a time and the system subsequently analyzed and further modified with respect to one or more performance metrics, for example in accordance with an iterative design process. Constrained optimization algorithms such as genetic algorithms may be employed in derivation of a design of an apparatus for use with a prespecified antenna system or range of antenna systems, for example.

In some embodiments, design may comprise elements of plural approaches, such as expert knowledge, trial and error, simulation, theoretical or computer modeling, prototyping, and the like. Design may be performed with the goal of achieving one or more objectives, or a balance or trade-off between plural objectives, such as hotspot mitigation, SAR compliance, antenna system total radiated power, antenna system resonant frequency, impedance matching, bandwidth, efficiency, and/or the like.

The invention will now be described with reference to specific examples. It will be understood that the following examples are intended to describe embodiments of the invention and are not intended to limit the invention in any way.

EXAMPLES

Example 1

Figure 2A:
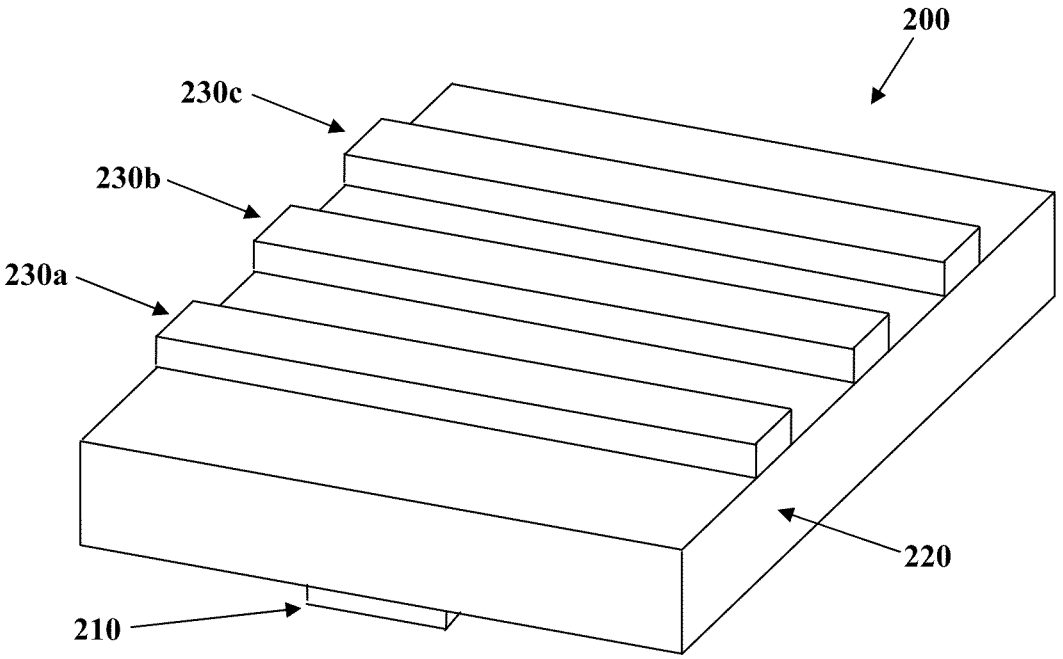
FIG. 2A illustrates a perspective view of an apparatus for mitigating undesired portions of electromagnetic radiation associated with an antenna in accordance with embodiments of the present invention.
Figure 2B:
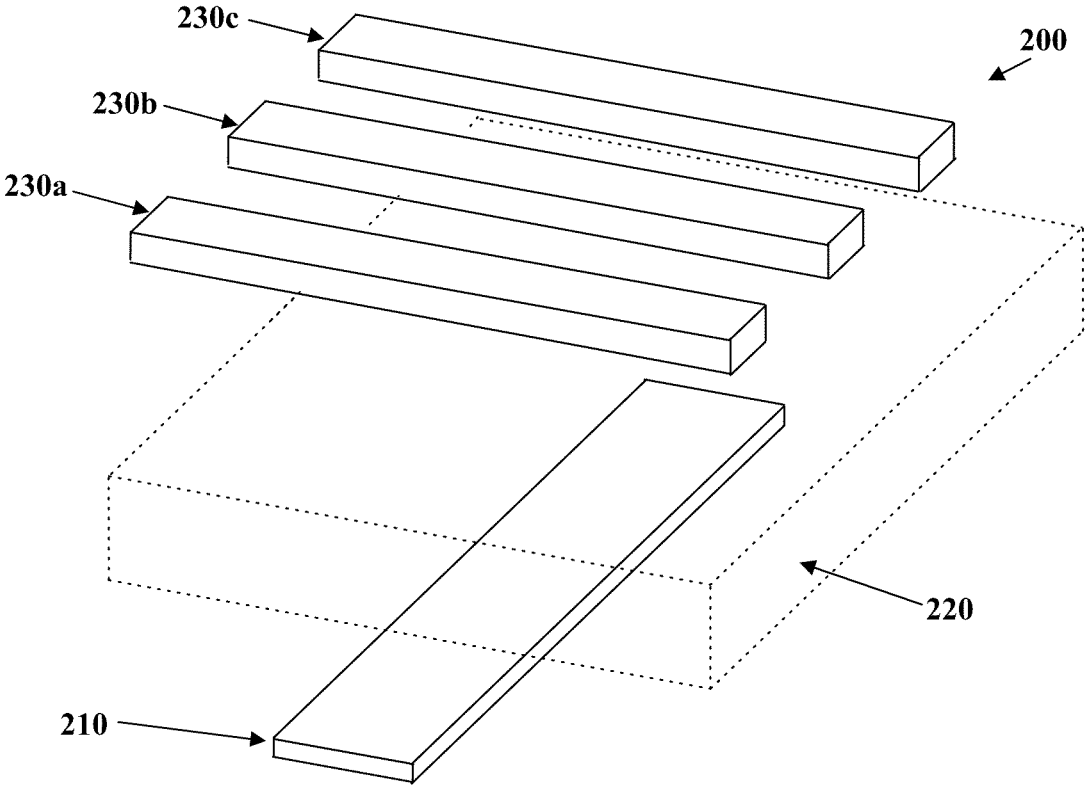
FIG. 2B illustrates an exploded view of the apparatus illustrated in FIG. 2A.

FIGS. 2A and 2B illustrate an apparatus 200 for mitigating undesired portions of electromagnetic radiation associated with an antenna in accordance with an embodiment of the present invention. FIG. 2B is an exploded view of FIG. 2A. The apparatus 200 comprises a coupler 210, an intermediate layer of insulating or dielectric material 220 and a plurality of dissipaters 230*a*, 230*b*, 230*c*. The coupler 210 is coupled to a first side of the intermediate layer 220, while the dissipaters 230*a*, 230*b*, 230*c* are coupled to a second side of the intermediate layer 220 opposite the first side.

The coupler 210 is a substantially rectangular strip of conductive material, such as copper, thin flexible conductor, or the like. The coupler 210 may be bonded to the intermediate layer 220, etched or deposited onto the surface of the intermediate layer 220, or formed in a layer of material coupled to the intermediate layer 220.

The intermediate layer 220 has a thickness T, configured to separate the coupler 210 from the dissipaters 230*a*, 230*b*, 230*c* by a desired separation distance. For example, the separation distance may be substantially smaller than a separation distance between the coupler 210 and an antenna EM inductively coupled thereto (not shown).

The dissipaters 230*a*, 230*b*, 230*c* may be substantially rectangular strips of conductive material, such as copper, thin flexible conductor, or the like, and may be bonded to the intermediate layer 220, etched or deposited onto the surface of the intermediate layer 220, or formed in a layer of material coupled to the intermediate layer 220.

The coupler 210 and dissipaters 230*a*, 230*b*, 230*c* are configured as elongated bodies, the coupler 210 having its longest side substantially perpendicular to the longest sides of the dissipaters 230*a*, 230*b*, 230*c*. Electromagnetic radiation emitted by dissipaters 230*a*, 230*b*, 230*c* at one or more predetermined frequencies may thereby be substantially orthogonally polarized to the coupler 210. That is, EMR emitted by the dissipaters at the one or more predetermined frequencies is polarized so such that the coupler 210 is substantially non-resonant with respect to said emitted EMR. Moreover, electromagnetic radiation emitted by dissipaters 230*a*, 230*b*, 230*c* at one or more predetermined frequencies may similarly be orthogonally or differently polarized to an antenna co-polarized with the coupler.

The apparatus 200 may be rigid or flexible. The apparatus may be integrally formed with a communication device, or attached to a communication device by soldering, adhesive, fasteners such as screws, or the like.

Example 2

Figure 3:
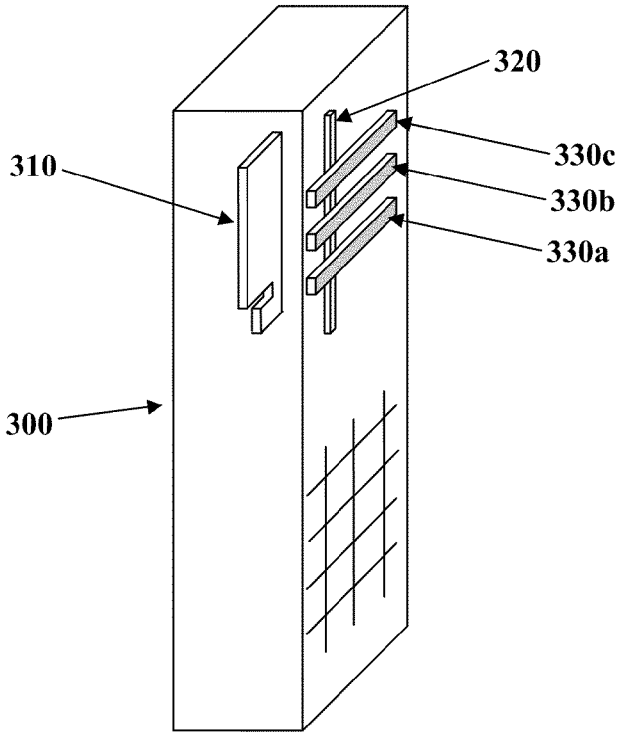
FIG. 3 illustrates a communication device configured for mitigating undesired portions of electromagnetic radiation associated with an antenna internal thereto in accordance with embodiments of the present invention.

FIG. 3 illustrates a communication device 300 configured for mitigating undesired portions of electromagnetic radiation associated with an antenna 310 internal thereto in accordance with an embodiment of the present invention. The communication device 300 comprises a coupler 320, such as a strip of conductive material, which is substantially co-polarized with the antenna 310. The coupler is separated from the antenna 310 by a predetermined distance. The communication device further comprises a plurality of dissipaters 330*a*, 330*b*, 330*c*, each of which is substantially differently polarized from the antenna 310.

The communication device 300 may be a cellular telephone, wireless adapter, machine-type wireless communication device, or other wireless device, as would be readily understood by a worker skilled in the art.

The coupler 320 and dissipaters 330*a*, 330*b*, 330*c* may be integrally formed with the communication device 300, or attached thereto by soldering, adhesive, fasteners such as screws, or the like. The coupler 320 and dissipaters 330*a*, 330*b*, 330*c* may be coupled to an intermediate insulating layer, for example described with respect to FIG. 2.

Example 3

Figure 4:
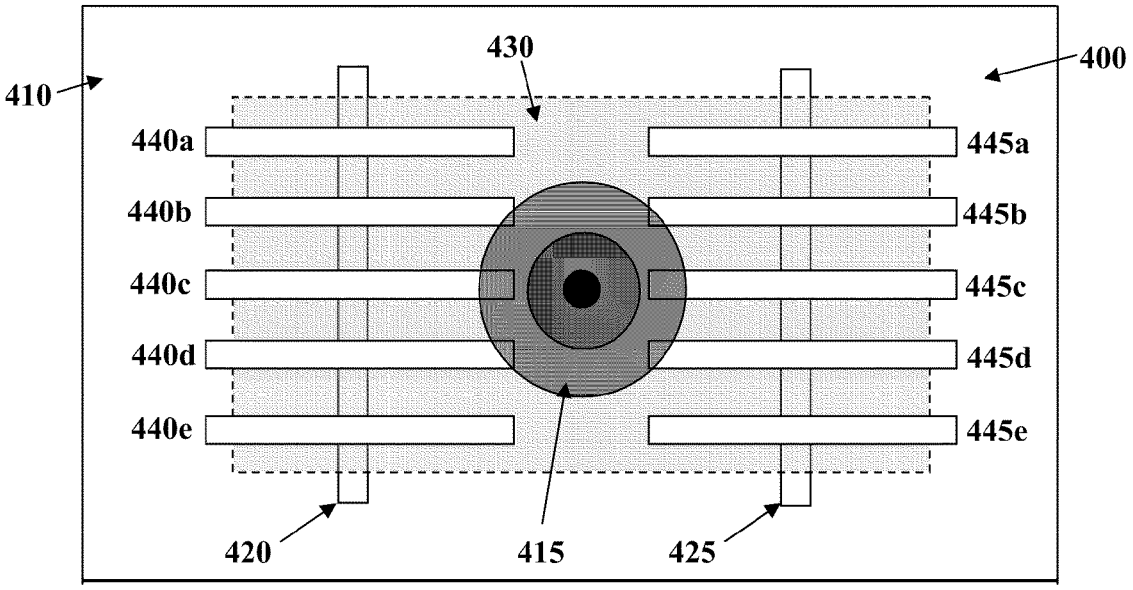
FIG. 4 illustrates an apparatus for mitigating undesired portions of electromagnetic radiation associated with an antenna in accordance with embodiments of the present invention.

FIG. 4 illustrates an apparatus 400 for mitigating undesired portions of electromagnetic radiation associated with an antenna in accordance with an embodiment of the present invention. The apparatus 400 is mounted on a housing 410 for example of a communication device. The housing 410 contains an antenna (not shown) which is associated with a hotspot 415. The apparatus 400 is located within the hotspot 415, and configured to mitigate the hotspot.

As illustrated in FIG. 4, the apparatus 400 comprises two couplers 420, 425, substantially co-polarized with the antenna and EM inductively coupled thereto. The apparatus further comprises dissipaters 440*a*, 440*b*, 440*c*, 440*d*, 440*e* EM inductively coupled to coupler 420, and dissipaters 445*a*, 445*b*, 445*c*, 445*d*, 445*e* EM inductively coupled to coupler 425. The dissipaters are substantially cross-polarized with the antenna. The apparatus further comprises an insulating or dielectric layer 430 or air gap between the couplers and dissipaters.

The size, shape, orientation, spacing, placement, material, and the like of apparatus 400 are configured to mitigate EM field strength due to the hotspot, for example on the side of the apparatus 400 opposite the antenna. The apparatus may be configured to absorb and reradiate RF energy due to the hotspot, for example by diffusing it.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

I claim:

1. An apparatus for mitigating undesired portions of electromagnetic radiation (EMR) associated with an antenna, the apparatus comprising:

a. a coupling element EM inductively coupled with the antenna, the coupling element being co-polarized with the antenna; and b. one or more dissipating elements EM inductively coupled with the coupling element, each of the one or more dissipating elements being differently polarized than the antenna;

wherein the coupling element is positioned at a fixed predetermined location proximate to the antenna between the antenna and the one or more dissipating elements such that EMR is reduced in a predetermined spatial region, and wherein the coupling element and the one or more dissipating elements form a barrier between the antenna and the predetermined spatial region operable to limit EMR in the predetermined spatial region.

2. The apparatus according to claim 1, further comprising a body of dielectric material having a first face opposite a second face, the first face having disposed thereon the coupling element, the second face having disposed thereon the one or more dissipating elements.

3. The apparatus according to claim 1, wherein the coupling element is separated from the antenna by a first separation distance, and the one or more dissipating elements are separated from the coupling conductive element by a second separation distance, the second separation distance being smaller than the first separation distance.

4. The apparatus according to claim 1, wherein the predetermined spatial region corresponds to a hotspot of the antenna.

5. The apparatus according to claim 1, wherein the predetermined spatial region corresponds to an expected location of a proximate human.

6. The apparatus according to claim 1, wherein the one or more dissipating elements are cross-polarized with the antenna.

7. The apparatus according to claim 1, wherein coupling element is a substantially rectangular strip of conductive material.

8. The apparatus according to claim 7, wherein a longest dimension of the coupling element is substantially parallel to an electric field associated with the antenna.

9. The apparatus according to claim 1, wherein the coupling element is oriented to induce about a maximum of current within the coupling element due to RF energy radiated by the antenna within a predetermined frequency range.

10. An apparatus for mitigating undesired portions of electromagnetic radiation (EMR) associated with an antenna, the apparatus comprising:

a. a coupling element EM inductively coupled with the antenna, the coupling element being co-polarized with the antenna; and b. one or more dissipating elements EM inductively coupled with the coupling element, each of the one or more dissipating elements being differently polarized than the antenna;

wherein the coupling element is positioned at a fixed predetermined location proximate to the antenna between the antenna and the one or more dissipating elements such that EMR is reduced in a predetermined spatial region, wherein the coupling element is separated from the antenna bya first separation distance, and the one or more dissipating elements are separated from the coupling conductive element by a second separation distance, the second separation distance being smaller than the first separation distance, and wherein the second separation distance is smaller than the first separation distance by at least a decade.

11. A communication device comprising an antenna and an apparatus for mitigating undesired portions of electromagnetic radiation (EMR) associated with an antenna, the apparatus comprising:

a. a coupling element EM inductively coupled with the antenna, the coupling element being co-polarized with the antenna; and b. one or more dissipating elements EM inductively coupled with the coupling element, each of the one or more dissipating elements being differently polarized than the antenna;

wherein the coupling element is positioned at a fixed predetermined location proximate to the antenna between the antenna and the one or more dissipating elements such that EMR is reduced in a predetermined spatial region, and wherein the coupling element and the one or more dissipating elements form a barrier between the antenna and the predetermined spatial region operable to limit EMR in the predetermined spatial region.

12. The communication device according to claim 11, further comprising a body of dielectric material having a first face opposite a second face, the first face having disposed thereon the coupling element, the second face having disposed thereon the one or more dissipating elements.

13. The communication device according to claim 11, wherein the coupling element is separated from the antenna by a first separation distance, and the one or more dissipating elements are separated from the coupling conductive element by a second separation distance, the second separation distance being smaller than the first separation distance.

14. The communication device according to claim 13, wherein the second separation distance is smaller than the first separation distance by at least a decade.

15. The communication device according to claim 11, wherein the predetermined spatial region corresponds to a hotspot of the antenna.

16. The communication device according to claim 11, wherein the predetermined spatial region corresponds to an expected location of a proximate human.

17. An apparatus for mitigating undesired portions of electromagnetic radiation (EMR) associated with an antenna, the apparatus comprising:

a. a coupling element EM inductively coupled with the antenna, the coupling element being co-polarized with the antenna; and b. one or more dissipating elements EM inductively coupled with the coupling element each of the one or more dissipating elements being differently polarized than the antenna;

wherein the coupling element is positioned at a fixed predetermined location proximate to the antenna between the antenna and the one or more dissipating elements such that EMR is reduced in a predetermined spatial region, wherein the coupling element is separated from the antenna by a first separation distance and the one or more dissipating elements are separated from the coupling conductive element by a second separation distance, the second separation distance being smaller than the first separation distance, and wherein the coupling element is a conductive cylinder.

18. A method for mitigating undesired portions of electromagnetic radiation (EMR) associated with an antenna, the method comprising:

a. Electromagnetically coupling a first element with an antenna, wherein the first element is substantially co-polarized with the antenna; and b. Electromagnetically coupling one or more second elements with the first element, wherein each of the one or more second elements is differently polarized than the antenna;

wherein the first element is positioned at a fixed predetermined location proximate to the antenna between the antenna and the one or more second elements such that EMR is reduced in a predetermined spatial region, and wherein the first element and the one or more second elements form a barrier between the antenna and the predetermined spatial region operable to limit EMR in the predetermined spatial region.

19. The method to claim 9, further comprising placing the first element and the one or more second elements between the antenna and a hotspot.

* * * * *